US007730555B2

(12) United States Patent
Hexels

(10) Patent No.: US 7,730,555 B2
(45) Date of Patent: Jun. 8, 2010

(54) PROTECTIVE CLOTHING FOR THE LOWER PART OF THE LEG

(75) Inventor: Gerd Hexels, Nettetal (DE)

(73) Assignee: Texplorer GmbH, Nettetal (DE)

( * ) Notice: Subject to any disclaimer, the term of this patent is extended or adjusted under 35 U.S.C. 154(b) by 269 days.

(21) Appl. No.: 10/581,898

(22) PCT Filed: Nov. 30, 2004

(86) PCT No.: PCT/EP2004/013577

§ 371 (c)(1),
(2), (4) Date: Jun. 5, 2006

(87) PCT Pub. No.: WO2005/053445

PCT Pub. Date: Jun. 16, 2005

(65) Prior Publication Data

US 2007/0118974 A1 May 31, 2007

(30) Foreign Application Priority Data

Dec. 6, 2003 (DE) ..... 103 57 112

(51) Int. Cl.
*A43B 17/00* (2006.01)

(52) U.S. Cl. ..... 2/239

(58) Field of Classification Search ..... 2/239, 2/409, 904, 455–457, 161.6, 243.1; 36/10, 36/55

See application file for complete search history.

(56) References Cited

U.S. PATENT DOCUMENTS 3,090,047 A * 5/1963 De Grazia ..... 112/425
4,206,514 A * 6/1980 Yamauchi ..... 2/239
4,217,386 A * 8/1980 Arons et al. ..... 428/198
4,228,549 A * 10/1980 Rispoli ..... 2/239
4,457,345 A * 7/1984 von Blucher et al. ..... 139/420 R
4,513,047 A * 4/1985 Leach et al. ..... 428/175
4,520,623 A * 6/1985 Ogawa et al. ..... 57/236

(Continued)

FOREIGN PATENT DOCUMENTS

| | | |
|---|---|---|
| DE | 19918425 | 10/2000 |
| EP | 0 705 543 | 4/1996 |
| EP | 1269877 | 1/2003 |
| FR | 2729831 | 8/1996 |
| FR | 2752994 | 3/1998 |
| WO | WO 89/04611 | 6/1989 |

OTHER PUBLICATIONS

Price, Arthur et al.; J.J. Pizzuto's Fabric Science, Seventh Edition; Fairchild Publications, Inc., New York, 2002.*
DE 103 47 673 A1, Hasso, Von Blucher, filed: Sep. 10, 2003.*
DE 103 47 673: Translation.*

*Primary Examiner*—Alissa L Hoey
(74) *Attorney, Agent, or Firm*—Davis & Bujold, P.L.L.C.

(57) ABSTRACT

Lower leg protective apparel, in particular protective socks, against chemical and/or biological noxiants composed of a plurality of plies, comprising an outside leg part (1) and, disposed in the interior of the outside leg part (1), a laminate (2) which comprises a flexible, windproof and water-rejecting membrane (7) which forms the outer surface of the laminate (2) and which forms at least a barrier to biological noxiants, a carbon layer (8) which is disposed underneath the membrane (7) and which comprises carbon in fibrous or particulate form, and an inner textile ply (9) which is characterized in that the outside leg part (1) is fabricated from a plurality of cuts (4, 5, 6) and in that the seams of the laminate (2) disposed in the interior of the outer leg part (1) are sealed off by a waterproof material.

19 Claims, 1 Drawing Sheet

U.S. PATENT DOCUMENTS 4,550,446 A * 11/1985 Herman ..... 2/239
4,599,810 A * 7/1986 Sacre ..... 36/55
4,753,182 A * 6/1988 Blackburn ..... 112/419
4,809,447 A * 3/1989 Pacanowsky et al. ..... 36/9 R
4,865,903 A * 9/1989 Adiletta ..... 428/215
4,869,947 A * 9/1989 Kirayoglu ..... 428/198
4,872,220 A * 10/1989 Haruvy et al. ..... 2/243.1
4,932,078 A * 6/1990 Jones et al. ..... 2/70
5,112,666 A 5/1992 Langston
5,157,791 A * 10/1992 Woodson et al. ..... 2/239
5,190,806 A * 3/1993 Nomi ..... 428/198
5,233,821 A * 8/1993 Weber et al. ..... 57/224
5,399,418 A * 3/1995 Hartmanns et al. ..... 428/218
5,494,720 A * 2/1996 Smith et al. ..... 428/57
5,526,584 A * 6/1996 Bleimhofer et al. ..... 36/10
5,731,065 A * 3/1998 Stelzmuller et al. ..... 428/198
6,009,559 A * 1/2000 Sesselmann ..... 2/243.1
6,134,718 A * 10/2000 Sesselmann ..... 2/243.1
6,571,397 B1 * 6/2003 Williams ..... 2/239
6,662,377 B2 * 12/2003 Williams ..... 2/239
7,111,327 B1 * 9/2006 Blauer et al. ..... 2/82
7,160,369 B2 * 1/2007 von Blucher et al. ..... 96/132
7,354,475 B2 * 4/2008 Von Blucher ..... 96/134
7,445,799 B1 * 11/2008 Sarangapani et al. ..... 424/618
7,465,490 B2 * 12/2008 Von Blucher ..... 428/316.6
2003/0044563 A1 * 3/2003 Kocinec et al. ..... 428/63
2003/0138586 A1 * 7/2003 Fowler ..... 428/57
2003/0177566 A1 * 9/2003 Williams ..... 2/239
2003/0229936 A1 * 12/2003 Tremblay-Lutter et al. ..... 2/455
2004/0060102 A1 * 4/2004 Brookman ..... 2/457
2005/0022920 A1 * 2/2005 Fowler ..... 156/88
2005/0076418 A1 * 4/2005 von Blucher ..... 2/161.6
2005/0076541 A1 * 4/2005 von Blucher ..... 36/113
2006/0191058 A1 * 8/2006 Huza ..... 2/239
2007/0000017 A1 * 1/2007 Hofmann ..... 2/159
2007/0004301 A1 * 1/2007 Heinrich et al. ..... 442/121
2007/0059504 A1 * 3/2007 von Blucher ..... 428/220
2007/0275619 A1 * 11/2007 von Blucher et al. ..... 442/80

* cited by examiner

PROTECTIVE CLOTHING FOR THE LOWER PART OF THE LEG

This application is a national stage completion of PCT/EP2004/013577filed Nov. 30, 2004 which claims priority from German Patent Application Serial No. 103 57 112.4 filed Dec. 6, 2003.

FIELD OF THE INVENTION

This invention relates to lower leg protective apparel, in particular protective socks, against chemical and/or biological noxiants.

BACKGROUND OF THE INVENTION

Lower leg protective apparel is known in the civilian field, in particular in the medical field. For instance, EP 0 705 543 B1 describes a lower leg protection garment which is said to provide a taping effect as a measure to prevent injury, or the recurrence of an injury, during sports or training activities.

Waterproof breathable socks are also known (see for example EP 0 386 144 B1).

DE 199 18 425 A1 describes a protective shoe in which an inner shoe is configured as a stocking using a breathable membrane.

EP 1 269 877 describes a protective suit in the form of an overall for protection against chemical noxiants.

The disadvantage with known protective suits against chemical and/or biological noxiants in the military field is that they only reach as far as the ankle and thus leave the feet unprotected. Overboots made of 100% butyl are used to protect the feet.

However, a disadvantage with this is that the boots can only be put on once the soldier has put on the protective suit. But since the protective suits are usually very stiff, it is comparatively difficult to pull on the overboots. Nor are the known overboots breathable and they are comparatively cumbersome and large. Moreover, since they are separate from the protective suits they are also liable to be lost.

SUMMARY OF THE INVENTION

The present invention therefore has for its object to provide lower leg protective apparel, in particular a protective sock which avoids the aforementioned disadvantages, in particular which offers a high wear comfort and can be worn like a conventional sock or stocking.

This object is achieved according to the present invention by lower leg protective apparel, in particular a protective sock which has a plurality of plies, comprising an outside leg part and, disposed in the interior of the outside leg part, a laminate which comprises a flexible, windproof and water-rejecting membrane which forms the outer surface of the laminate and which forms at least a barrier to biological noxiants, a carbon layer which is disposed underneath the membrane and which comprises carbon in fibrous or particulate form, and an inner textile ply.

The lower leg protective apparel of the present invention offers a high level of wear comfort as well as protection against chemical and/or biological noxiants. It is very flexible and can be worn like a "normal" stocking or sock. More particularly, the lower leg protective apparel of the present invention can be put on before the suit is put on, and this means that in the event of deployment a person wearing a protective suit will be dressed more quickly and, what is more, possesses superior freedom of movement.

When the membrane is breathable in accordance with the present invention, wear comfort will be even superior.

The outer leg part, when it is configured as a sock, can constitute an outside sock composed of wool, cotton, silk, polyester, polypropylene, polyamide, polyacrylic, modifications or mixtures thereof. The laminate of the present invention provides protection against chemical and/or biological noxiants. The windproofness of the membrane prevents wind getting into the carbon layer underneath and thereby impairing its performance. The waterproofness simultaneously prevents liquid chemicals wetting through or penetrating into the carbon layer, which would likewise lead to impaired performance.

As well as acting as a barrier against biological noxiants, the membrane, if appropriately configured, will also act as a filter against noxiants.

In the event that liquid noxiants do succeed in penetrating, they will disperse in the membrane and will generally be blocked out. To the extent that they are not blocked out, they will diffuse through the membrane so slowly that they arrive at the carbon layer in a state for which the carbon layer is effective. This mechanism greatly increases the number of chemicals against which a protective effect is achieved. Practical tests have shown that the laminate of the present invention possesses a distinctly superior and, most importantly, more prolonged protective effect than known materials.

When hydrophilic membranes, opposed to hydrophobic membranes, are used, there will be no microporosity, and this provides a barrier against biological noxiants. However, water vapor molecules are nonetheless capable of passing through, water is not.

Since the upstream membrane already provides some protective effect, the carbon layer underneath can be made thinner without impairing its performance. This appreciably increases the wear comfort, since the carbon layer, which traps the heat, is thinner.

Examples of further advantageous materials for the membrane are cellophane-based materials, polyvinyl alcohol, polyacrylamides, polyurethanes and mixtures thereof.

When microporous membranes, for example polytetrafluoroethylene, are used, breathability is achieved despite windproofness and waterproofness.

It is advantageous according to the present invention to choose such a small pore size that only water vapor will pass through the small pores. Since biological noxiants are generally larger, they are thereby prevented from passing through.

The carbon layer can comprise of a woven or loop-formingly knit fabric having 100% activated fibers or else activated carbon spherules which were applied to a supporting material.

The wear comfort is more distinctly improved when, in addition to the outside leg part, an inside leg part is disposed on the inside surface, i.e., the wearer-facing side, of the laminate. The inside leg part may, if configured as an innersock, be made of manufactured fibers, for example polypropylene, polyamide, polyester, modifications and mixtures thereof.

The textile ply can be a textile fabric which forms a mechanically protecting layer for the carbon layer. On the outside, the membrane, as well as its protective effect against noxiants, likewise forms a mechanically protecting layer for the fiber layer.

BRIEF DESCRIPTION OF THE DRAWINGS

Operative examples of the invention will now be described in outline with reference to the drawing, where.

DETAILED DESCRIPTION OF THE INVENTION

The lower leg protective apparel of the present invention will now be described with reference to a protective sock. It will be understood, however, that other forms of lower leg protective apparel, such as stockings for example, are possible in the design of the present invention.

Figure 1:
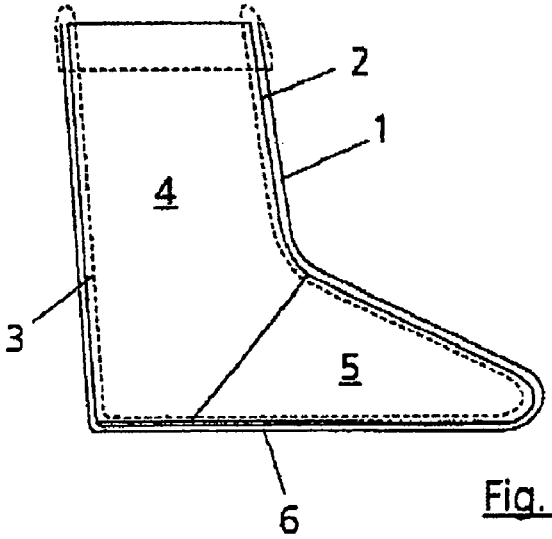
FIG. 1 shows a side view of the present invention's lower leg protective apparel as a protective sock.
Figure 2:
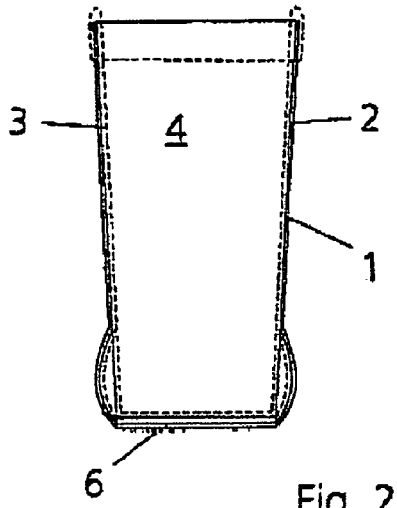
FIG. 2 shows a rear view of the protective sock according to FIG. 1.

The protective sock depicted in FIGS. 1 and 2 comprises an outside leg part in the form of an outersock 1. In the interior of the outersock 1 is disposed a laminate 2 whose construction will be more particularly described hereinbelow with reference to FIGS. 6 and 7. On the inside, to complete the protective sock, an innersock 3 is disposed as inside leg part.

The three plies, consisting of outersock 1, laminate 2 and innersock 3, are bonded together and are conjointly pulled on as one protective sock. The bonding between the three plies can take the form of sewing and/or adhering for example. The sewing can be effected for example in the region of the upper ends of the three plies and additionally also in the heel and foot tip region, for example by means of yarns.

The innersock 3 may be hydrophilic, if appropriate. At the seam locations, the innersock 3 should be loop-drawingly knit from soft, fleecy spun yarn in order that pressure points on the foot may be prevented.

When the innersock 3 is made longer than the laminate 2 and the outersock 1, the innersock 3 may be turned at the upper end outwardly over the laminate 2 and the outersock 1 in the form of a cuff, as indicated by the broken lines in FIGS. 1 and 2. In the case of a hydrophilic innersock 3, absorbed moisture can thereby be transported to the outside where it can evaporate.

Figure 3:
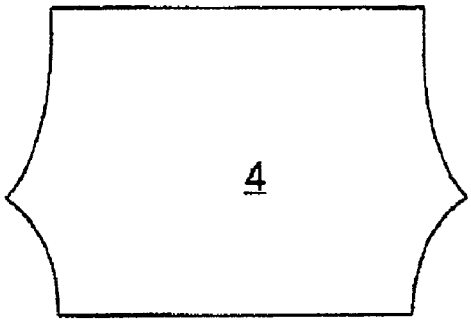
FIG. 3 shows a cut for a shaft of the laminate of the present invention.
Figure 4:
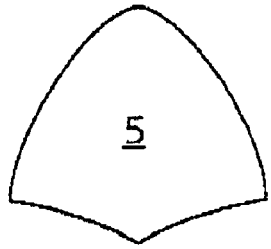
FIG. 4 shows a cut for a foot upper part of the laminate.
Figure 5:
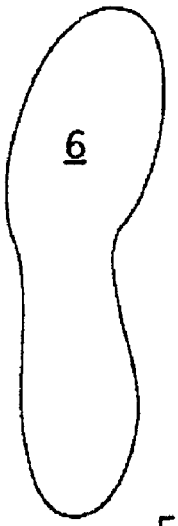
FIG. 5 shows a cut for a sole of the laminate.

The outersock 1 and innersock 3 can be fabricated from a plurality of cuts. Of course, the outersock 1 and the innersock 3 can also be woven or loop-formingly knit without seam. The laminate 2 can be produced from three cuts, as shown in FIGS. 3 to 5. FIG. 3 shows the cut for a shaft 4 of the laminate. FIG. 4 shows the cut for a foot upper part 5 and FIG. 5 shows a cut for a sole 6 of the laminate. The same applies mutatis mutandis to the outersock 1 when it is likewise fabricated from cuts.

The three cuts can be joined together by means of a flatlock stitch or a zigzag stitch, in which case the seams are sealed off with a waterproof material. The waterproof material can consist for example of a waterproof seam-sealing tape. Similarly, the three cuts may be bonded together by water- and gasproof adhesives, which likewise should form a barrier against noxiants.

Figure 6:
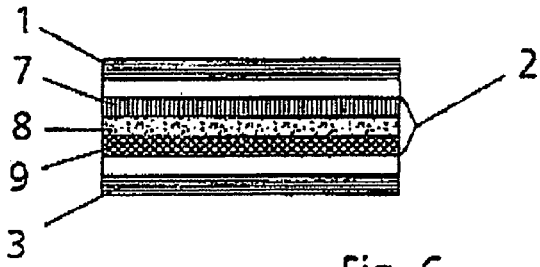
FIG. 6 shows a much enlarged cross section through the construction of the protective sock.

FIG. 6 shows a much enlarged cross section of the construction of the protective sock composed of three plies, namely the outersock 1, the laminate 2 and the innersock 3. FIG. 6 further shows the construction of the laminate 2, which consists of three layers. The outer, i.e., wearer-remote, side of the laminate 2 is formed by a membrane 7. Underneath the membrane 7, i.e., on the wearer-facing side, there is a carbon layer 8, and a textile ply 9 is provided as an internal layer.

The membrane 7, the carbon layer 8 and the textile ply 9 are laminated together in a known manner to form a single unit. This can be effected for example by a point-for-point lamination, in which case adhesive is applied dotwise between the two layers to be bonded together and the layers are then bonded together in the course of a passage through pressing rolls. The process of lamination can be carried out with or without heating.

Figure 7:
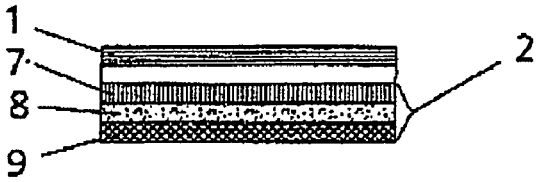
FIG. 7 shows a much enlarged cross section through a protective sock in another construction.

FIG. 7 shows in principle the same construction as the operative example of the protective sock according to FIG. 6. The sole difference is that, in this case, the innersock 3 is missing, so that the textile ply 9, which in this case will be made hydrophilic, of the laminate 2 is next to the foot of the wearer. The membrane 7 is flexible in order that it may stretch both in the transverse direction and in the longitudinal direction and rupture may be avoided.

When the carbon layer 8 is a fabric, very good washing properties are obtained.

The active carbon layer 8 can be produced in fiber form from a loop-drawingly knit or woven fabric. To produce active fibers of carbon it is known to subject viscose fibers or a woven or loop-drawingly knit viscose fabric to a controlled combustion which is directed such as to produce activated carbon having extremely fine pores which then generate the filtering effect.

The thickness of the carbon layer 8 can be between 0.2 to 1.0 mm and preferably between 0.4 to 0.8 mm.

Advantageous active surface areas for the carbon layer 8 are in a range from 800 to 2000 $m^2/g$ and preferably between 1000 to 1200 $m^2/g$.

The invention claimed is:

1. A lower leg protective apparel for providing protection from one of chemical and biological noxiants, the lower leg protective apparel comprising:

a sock having a toe section and a heel section, and the sock having a plurality of plies and comprising:

an outersock (1), a laminate (2), disposed on an inner side of the outersock (1), consisting of first, second and third layers, the first layer being a single flexible, windproof, breathable and water-rejecting membrane (7) which forms the outer surface of the laminate (2) and which forms at least a barrier to biological noxiants and at least a partial barrier to liquid chemical noxiants, the second layer being a single carbon layer (8) which is disposed underneath the membrane (7) and which comprises carbon in one of a fibrous form and as active spherules of carbon, the third layer being an inner textile ply (9), and an innersock (3) disposed as a second textile ply on an inner side of the laminate (2), wherein at least one of the outersock (1) and the innersock (3) is fabricated from a plurality of cuts (4, 5, 6), seams between the cuts (4, 5, 6) being sealed by a seam-sealing tape comprising a waterproof material, and the outersock (1), the laminate (2) and the innersock (3) are assembled to one another as a single unit by at least one of bonding and stitching.

2. The lower leg protective apparel according to claim 1, wherein the plurality of plies (1, 2, 3) are sewn together.

3. The lower leg protective apparel according to claim 2, wherein the plurality of plies (1, 2, 3) are sewn together at their upper ends and in a foot tip region.

4. The lower leg protective apparel according to claim 1, wherein the membrane (7) is microporous.

5. The lower leg protective apparel according to claim 4, wherein the membrane (7) comprises polytetrafluoroethylene.

6. The lower leg protective apparel according to claim 1, wherein a thickness of carbon layer (8) is in a range from 0.2 to 1.0 mm and the innersock (3) is hydrophilic.

7. The lower leg protective apparel according to claim 1, wherein the membrane (7) is based on cellophane.

8. The lower leg protective apparel according to claim 1, wherein the membrane (7) comprises one of polyvinyl alcohols, polyacrylamides or polyurethane.

9. The lower leg protective apparel according to claim 1, wherein the outersock (1) comprises one of wool, cotton, silk, polyester, polypropylene, polyamide, polyacrylic and mixtures thereof.

10. The lower leg protective apparel according to claim 1, wherein the inner textile ply (9) in the laminate (2) is one of a woven and a loop-formingly knit fabric.

11. The lower leg protective apparel according to claim 1, wherein the innersock (3) is hydrophilic, and the innersock (3) comprises one of polypropylene, polyamide, polyester and mixtures thereof.

12. The lower leg protective apparel according to claim 1, wherein the innersock (3) is made of manufactured fibers.

13. The lower leg protective apparel according to claim 1, wherein the innersock (3) is stitched with a fleecy spun yarn to at least one of the other plies (1, 2).

14. The lower leg protective apparel according to claim 1, wherein the inner textile ply (9) of the laminate (2) is hydrophilic.

15. A lower leg protective apparel for providing protection from at least one of chemical and biological noxiants, the lower leg protective apparel being a sock garment comprising:

a toe section and a heel section, and the sock garment having a plurality of plies and comprising:

an outersock (1), and a laminate (2), disposed on an inner side of the outersock (1), comprising:

a single flexible, windproof and water-rejecting membrane (7), comprising a polytetrafluoroethylene membrane, which forms the outer surface of the laminate (2) and pores of the membrane (7) have a size such that the pores are pervious to water vapor but the pores are resistant to permeation of biological and chemical noxiants through the pores, a single carbon layer (8) which is disposed underneath the membrane (7) and which comprises carbon in a fibrous form, and an inner textile ply (9), wherein at least the laminate is produced by a cut for a shaft (4), a cut for an upper part of a foot (5) and a cut for a sole (6), and seams between the cuts (4, 5, 6) are sealed by a waterproof material;

a thickness of carbon layer (8) is in a range from 0.2 to 1.0 mm; and an innersock (3) is hydrophilic.

16. A sock garment comprising:

a toe section and a heel section for protecting at least a foot of a wearer from one of chemical and biological noxiants, the sock garment having a plurality of plies and comprising:

an outersock (1), a laminate (2), disposed on an inner side of the outersock (1), comprising a single flexible, windproof and water-rejecting membrane (7) with the membrane (7) being one of a polyester, a polyether and a mixture of a polyester and a polyether and which forms the outer surface of the laminate (2) and which forms at least a barrier to biological noxiants and at least a partial barrier to liquid chemical noxiants, a single carbon layer (8) disposed underneath the membrane (7) and which comprises a fabric of one of a woven carbon fiber material and a loop-drawingly knit carbon fiber material, and an inner textile ply (9), wherein at least one of the outersock (1) and an innersock (3) is fabricated from a plurality of cuts (4, 5, 6), and seams between the cuts (4, 5, 6) are sealed by a waterproof material;

a thickness of carbon layer (8) is in a range from 0.2 to 1.0 mm;

the innersock (3), at an upper most portion of the sock garment, folds back over the laminate (2) and the outersock (1) and covers a portion of an outer side of the outersock (1) to expose the innersock (3) to an exterior of the sock garment and facilitate evaporation of moisture absorbed thereby and the innersock (3) is hydrophilic.

17. The sock garment according to claim 16, wherein an active surface area of a carbon layer (8) is in a range from 1000 to 1200 $m^2/g$.

18. The sock garment according to claim 16, wherein the innersock (3) comprises one of polypropylene, polyamide, polyester and mixtures thereof.

19. A sock garment for providing protection to at least a foot of a wearer from one of chemical and biological noxiants, the sock garment consisting of:

a toe section and a heel section, and the sock garment having first, second and third plies;

the first ply consisting of an outersock (1) comprising at least one of one of wool, cotton, silk, polyester, polypropylene, polyamide and polyacrylic;

the second ply being a laminate (2) consisting of first, second and third layers, with the first layer being adjacent an inner side of the outersock (1), the first layer of the laminate (2) consisting of a single flexible, windproof, breathable and water-rejecting membrane (7) which forms an outer surface of the laminate (2) and which forms at least a barrier to biological noxiants and at least a partial barrier to liquid chemical noxiants, the second layer of the laminate (2) consisting of a single carbon layer (8) which is disposed underneath the membrane (7) and which comprises carbon in a fibrous form from one of a woven and a loop-drawingly knit fabric, the third layer of the laminate (2) consisting of an inner hydrophilic textile ply (9) that is one of a woven and a loop-formingly knit fabric, and the third ply consisting of an innersock (3) that is hydrophobic and disposed adjacent the third layer of the laminate (2) and comprises at least one of polypropylene, polyamide and polyester;

wherein at least one of the outersock (1) and the innersock (3) is fabricated from a plurality of cuts (4, 5, 6), seams between the cuts (4, 5, 6) being sealed by a seam-sealing tape comprising a waterproof material, a thickness of carbon layer (8) is in a range from 0.2 to 1.0 mm;

the innersock (3), at an upper most portion of the sock garment, folds back over the laminate (2) and the outersock (1) and covers a portion of an outer side of the outersock (1) to facilitate evaporation of moisture absorbed thereby; and the outersock (1), the laminate (2) and the innersock (3) are bonded to one another as a single unit.

* * * * *